US011566461B2

(12) United States Patent
Zimmer et al.

(10) Patent No.: US 11,566,461 B2
(45) Date of Patent: Jan. 31, 2023

(54) RETRACTION DEVICE WITH SPRING ENERGY ACCUMULATOR WHICH CAN BE COUPLED

(71) Applicants: Martin Zimmer, Rheinau (DE); Günther Zimmer, Rheinau (DE)

(72) Inventors: Martin Zimmer, Rheinau (DE); Günther Zimmer, Rheinau (DE)

( * ) Notice: Subject to any disclaimer, the term of this patent is extended or adjusted under 35 U.S.C. 154(b) by 51 days.

(21) Appl. No.: 17/284,871

(22) PCT Filed: Oct. 13, 2019

(86) PCT No.: PCT/DE2019/000266
§ 371 (c)(1),
(2) Date: Apr. 13, 2021

(87) PCT Pub. No.: WO2020/078495
PCT Pub. Date: Apr. 23, 2020

(65) Prior Publication Data

US 2021/0388656 A1 Dec. 16, 2021

(30) Foreign Application Priority Data

Oct. 14, 2018 (DE) ..... 10 2018 008 202.5

(51) Int. Cl.
*E05F 1/16* (2006.01)
*A47B 88/467* (2017.01)
*E05F 5/02* (2006.01)

(52) U.S. Cl.
CPC ..... *E05F 1/16* (2013.01); *A47B 88/467* (2017.01); *E05F 5/027* (2013.01);
(Continued)

(58) Field of Classification Search
CPC ..... E05F 1/16; E05F 5/027; E05Y 2900/132; E05Y 2900/20; A47B 88/467; A47B 2088/4675
See application file for complete search history.

(56) References Cited

U.S. PATENT DOCUMENTS 7,472,973 B2 * 1/2009 Huang ..... A47B 88/467 312/319.1
8,745,821 B2 * 6/2014 Chang ..... E05F 5/003 16/49

(Continued)

FOREIGN PATENT DOCUMENTS

DE 102009053436 A1 5/2011
DE 102011010778 A1 8/2012
WO 2010043334 A1 4/2010

*Primary Examiner* — Victor D Batson
*Assistant Examiner* — Matthew J Sullivan
(74) *Attorney, Agent, or Firm* — Smartpat PLC

(57) ABSTRACT

A retraction device includes a housing and a driving element guided in the housing between a parked position and an end position. A first end of a spring energy accumulator is connected to the housing. The spring energy accumulator is loaded to a maximum operating value when the driving element is in the parked position and is unloaded to a residual energy value when the driving element is in the end position. A second end of the spring energy accumulator can either be fixed to the housing or coupled to the driving element by means of a bistable coupling. The coupling has a blocking element that can be moved between the housing and the driving element.

10 Claims, 5 Drawing Sheets

(52) U.S. Cl.
CPC ..... *A47B 2088/4675* (2017.01); *E05Y 2900/132* (2013.01); *E05Y 2900/20* (2013.01)

(56) References Cited

U.S. PATENT DOCUMENTS

| | | | | |
|---|---|---|---|---|
| 8,746,422 | B2 * | 6/2014 | Zimmer | E05F 5/003 188/322.19 |
| 8,833,878 | B2 * | 9/2014 | Lam | A47B 88/487 312/319.1 |
| 9,388,619 | B2 * | 7/2016 | Park | E05F 5/003 |
| 9,388,622 | B1 * | 7/2016 | Paron | E05F 15/56 |
| 9,435,152 | B2 * | 9/2016 | Zimmer | E05F 1/16 |
| 9,879,459 | B2 * | 1/2018 | Zimmer | F16C 41/001 |
| 10,113,349 | B2 * | 10/2018 | Zimmer | E05F 5/003 |
| 10,172,461 | B2 * | 1/2019 | Fischer | A47B 88/497 |
| 10,294,706 | B2 * | 5/2019 | Demir | E05F 5/027 |
| 10,653,240 | B2 * | 5/2020 | Goetz | E05F 1/16 |
| 10,745,955 | B2 * | 8/2020 | Svara | E05F 1/16 |
| 10,758,043 | B2 * | 9/2020 | Pohlmann | A47B 88/467 |
| 11,039,688 | B2 * | 6/2021 | Pecar | A47B 88/467 |
| 11,118,388 | B2 * | 9/2021 | Terno | E05F 5/003 |
| 11,162,289 | B2 * | 11/2021 | Wei | E05F 1/16 |
| 11,384,583 | B2 * | 7/2022 | Zimmer | E05F 5/003 |
| 2007/0278919 | A1 | 12/2007 | Lu | |
| 2014/0026357 | A1 | 1/2014 | Zimmer et al. | |
| 2020/0190882 | A1 * | 6/2020 | Bantle | E05F 5/06 |
| 2021/0340803 | A1 * | 11/2021 | Terno | E05F 5/003 |
| 2021/0355731 | A1 * | 11/2021 | Long | E05F 5/025 |

* cited by examiner

RETRACTION DEVICE WITH SPRING ENERGY ACCUMULATOR WHICH CAN BE COUPLED

CROSS-REFERENCE TO RELATED APPLICATION

This application is a national stage application, filed under 35 U.S.C. § 371, of International Patent Application No. PCT/DE2019/000266, filed on Oct. 13, 2019, which claims the benefit of German Patent Application No. 10 2018 008 202.5, filed Oct. 14, 2018.

TECHNICAL FIELD

The disclosure relates to a retraction device as used, for example, in furniture applications to guide drawers, sliding doors, etc. in a controlled manner into an open or closed end position.

BACKGROUND

A retraction device is generally known from DE 10 2011 010 778 A1. Impact noises may occur when the retraction device is released. In addition, damage to the components during operation may limit service life.

SUMMARY

The present disclosure is based on the problem of developing a low-noise retraction device with a long service life.

Such problem is resolved with the features of the main claim. A novel retraction device comprises a housing and a driving element guided in the housing between a parked position and an end position. A first end of a spring energy accumulator is connected to the housing. The spring energy accumulator is loaded to a maximum operating value when the driving element is in the parked position and is unloaded to a residual energy value when the driving element is in the end position. A second end of the spring energy accumulator can either be fixed to the housing or coupled to the driving element by means of a bistable coupling. The coupling has a blocking element that can be moved between the housing and the driving element.

The retraction device has a driving element that can be coupled to a spring energy accumulator in a path-dependent manner. In order switch the coupling between the two stable operating states, a blocking element arranged between the housing and the driving element is moved. In the first case, the blocking element couples the spring energy accumulator to the housing. For example, the housing has a recess for this purpose, which forms a claw of the coupling. The release of the coupling is prevented by the driving element, which can be moved relative to the housing.

When moving the driving element relative to the housing, the coupling can be switched. The driving element releases a movement of the blocking element, which penetrates a coupling claw of the driving element, for example a transverse channel, while simultaneously relieving the spring energy accumulator. After the coupling has been switched, the blocking element connects the spring energy accumulator to the driving element in a positive-locking manner. The release of the coupling is prevented by means of the housing. The driving element is connected to the spring energy accumulator, for example, in a partial stroke of its total stroke adjacent to the end position.

When using the retraction device in a piece of furniture, a coupling of the driver to the driving element can thus take place in a manner spatially and temporally offset relative to the coupling of the spring energy accumulator to the driving element. The spring energy accumulator moves only linearly, such that noise from the spring is avoided.

The driving element can additionally actuate a cylinder-piston unit mounted in the housing. This is formed as a damper, for example. The damper can be actuated before the spring energy accumulator is coupled. When the coupling is switched, the speed of the driving element is thus already decelerated. After coupling, the net force of the deceleration force of the cylinder-piston unit and the acceleration force of the unloading spring energy accumulator acts on the driving element.

The driving element can be formed in two parts. It then consists of a push pin part and a pull pin part, which are movable relative to each other. The push pin part and the pull pin part can be connected to each other in a swivel joint or in a sliding joint.

Further details of the invention arise in the subclaims and the following description of schematically illustrated embodiments.

DETAILED DESCRIPTION

Figure 1:
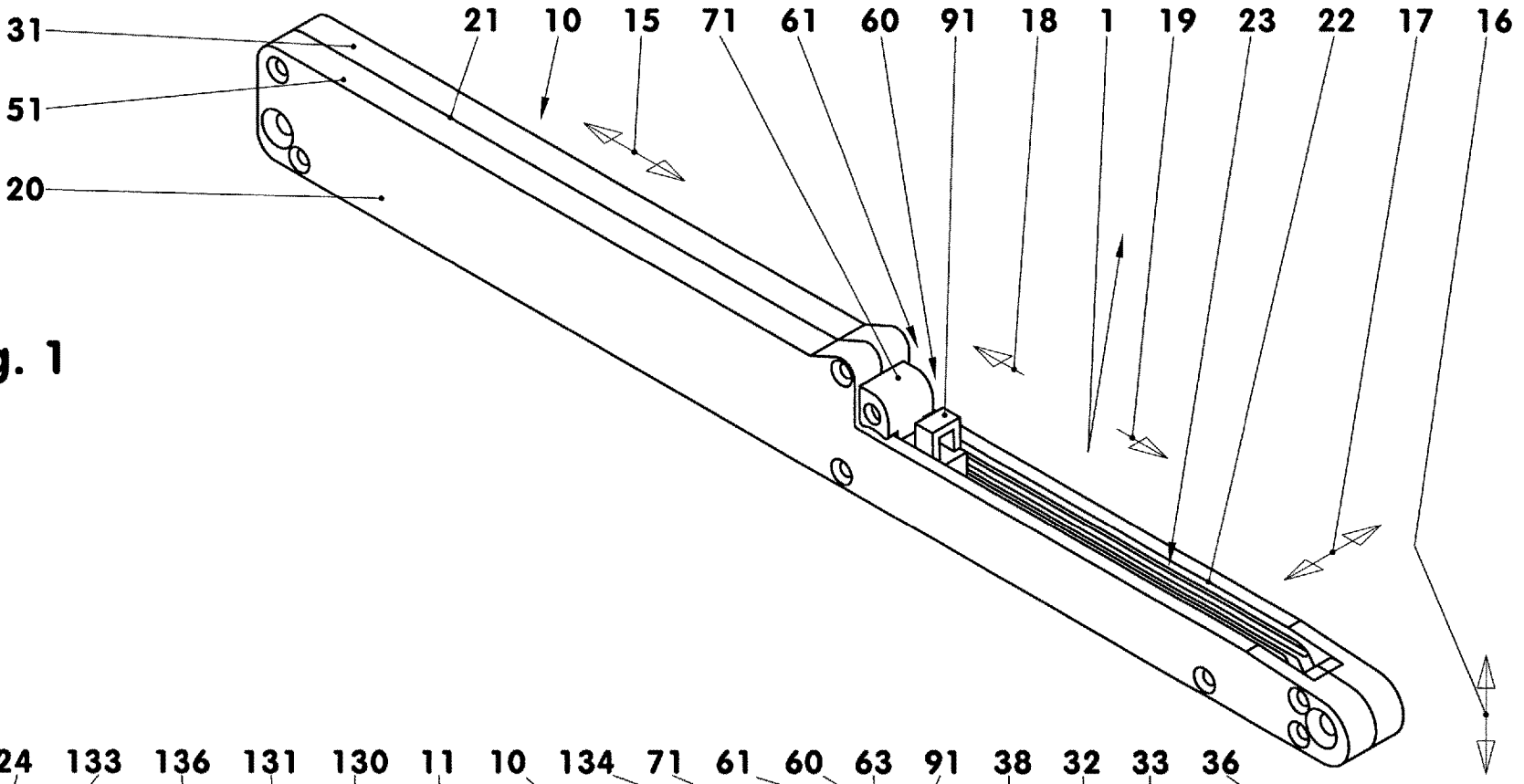
FIG. 1: Isometric illustration of a retraction device.

FIG. 1 shows a retraction device (10). Such retraction devices (10) are used, for example, to guide drawers, sliding doors, etc. in a controlled manner into an open or closed end position. The retraction devices (10) shown in the exemplary embodiments are combined acceleration and deceleration devices (10). In a partial stroke of the drawer or sliding door adjacent to an end position, a net force of an acceleration force of an acceleration device and a deceleration force of a deceleration device (11) acts on the relative movement of the drawer or sliding door with respect to a furniture body, etc. The retraction device (10) can also be formed without a deceleration device (11).

The retraction device (10) has a housing (20) consisting, for example, of two housing shells (31, 51) joined to each other. In the exemplary embodiment, the two housing shells (31, 51) are screwed to each other. However, they can also be riveted, glued, etc. to each other. The length of the housing (20) in the longitudinal direction (15) of the retraction device (10) is 300 millimeters in the exemplary embodiment. The height of the housing (20) in the height direction (16) is, for example, one tenth of such length. The total width in the width direction (17) is one-twentieth of the length in the exemplary embodiment.

On its upper side (21), the housing (20) has a longitudinal slot (22) oriented in the longitudinal direction (15) of the retraction device (10). A driving element (60) mounted in the interior (23) of the housing (20) projects into the surrounding area (1) through such longitudinal slot (22). The driving element (60) can be moved in the housing (20) along guide tracks (32, 33) on both sides between the end position (61) shown and a parked position (62), see FIG. 3, and back. The total stroke of the driving element (60) is, for example, one-third of the length of the retraction device (10).

Figure 2:
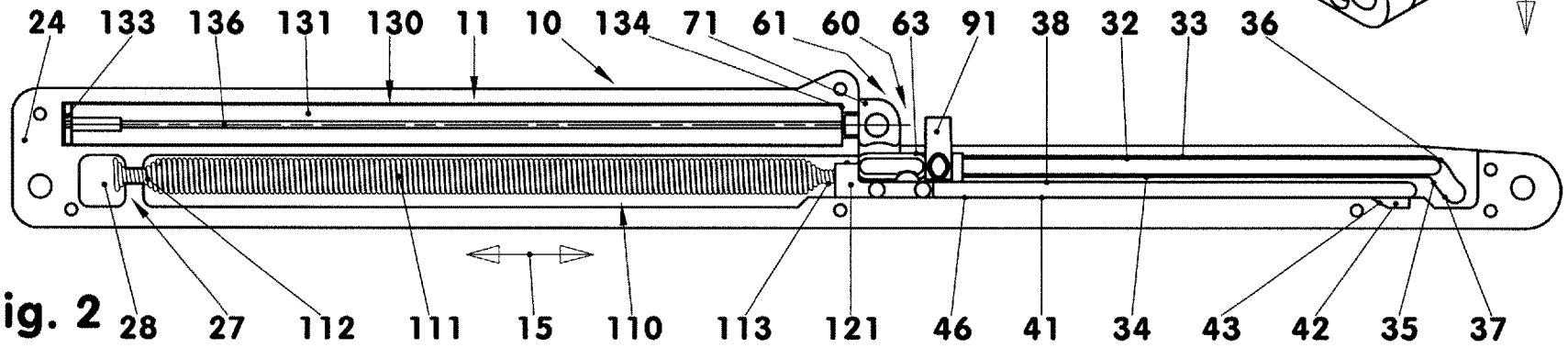
FIG. 2: Retraction device in the end position with the housing shell removed.

FIG. 2 shows the retraction device (10) with one housing shell (31; 51) removed. The driving element (60) is in the end position (61) as shown in FIG. 1. In such end position (61), the driving element (60) is coupled to a spring assembly (110). In one exemplary embodiment, the spring assembly includes a spring energy accumulator (111) having a first end (112) suspended in the housing (20) and a second end (113) suspended in a pin slider (121) of the spring assembly (110). It is also conceivable to design the spring assembly (110) without the pin slider (121). The spring energy accumulator (111) is then directly connected to the driving element (60), for example, when the driving element (60) is in the end position (61). In the exemplary embodiment, the spring energy accumulator (111) is formed as a tension spring (111). The spring retainer (27) on the housing side is located near the rear wall (24) of the housing (20). In the state shown, the tension spring (111) is stretched to a minimum operating length compared with its fully relaxed length. For example, it is loaded with a residual energy value.

Figure 3:
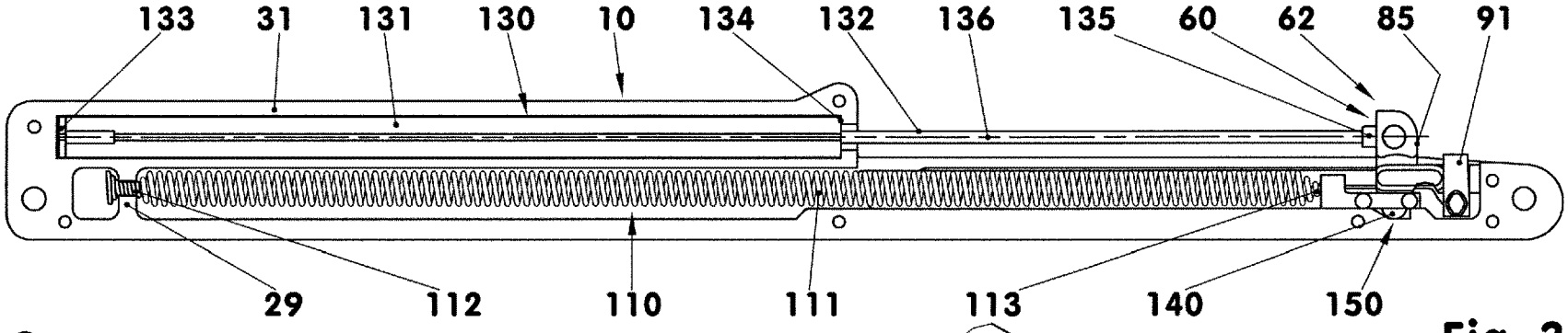
FIG. 3: Retraction device in the parked position with the housing shell removed.

Above the spring energy accumulator (111), for example, a cylinder-piston unit (130) is arranged in the illustrations of FIGS. 2 and 3. In the exemplary embodiment, this is a hydraulic cylinder-piston unit (130). The cylinder-piston unit (130) can also be a pneumatic device. The cylinder-piston unit (130) has a cylinder (131) and a piston guided in the cylinder (131) by means of a piston rod (132). When the piston is retracted by the piston rod (132), operating medium is moved in a throttled manner from a displacement chamber arranged between the piston and the cylinder base (133) into a compensation chamber located between the piston and the cylinder head (134). When the piston and piston rod (132) are extended, the operating medium flows largely without resistance from the compensation chamber into the displacement chamber. The cylinder-piston unit (130) has a center axis (136) that penetrates the cylinder (131) and the piston rod (132) in the longitudinal direction (15). In the exemplary embodiment, both the cylinder (131) and the piston rod (132) are arranged coaxially to the center axis (136).

In the illustrations of FIGS. 2 and 3, the piston rod (132) has a piston rod head (135) mounted in the driving element (60). It is also conceivable to form the piston rod head (135) with a stop surface for the driving element (60). In this case, the driving element (60) can separate from the piston rod (132), for example, during rapid movement from the end position (61) in the direction of the parked position (62). With one such variant, the cylinder-piston unit (130) has a return spring, for example in the form of a compression spring, which is arranged between the piston and the cylinder base (133). The retraction device (10) can also be formed without a cylinder-piston unit (130).

In the exemplary embodiment shown, the driving element (60) is formed with two parts. It consists of a push pin part (71) turned towards the pin slider (121) and a pull pin part (91) turned away from the pin slider (121). For example, the pull pin part (91) is movable in a plane normal to the longitudinal direction (15) of the retraction device (10) relative to the push pin part (71) in the height direction (16). In this case, it is guided on the push pin part (71). In this case, the push pin part (71) and the pull pin part (91) form a sliding joint, whose full prism is formed by the pull pin part (91) and whose hollow prism is formed by the push pin part (71). In the end position (61) shown in FIGS. 1 and 2, the pull pin part (91) is in an extended operating position (92). In the parked position (62) shown in FIG. 3, the pull pin part (91) is in a retracted ready position (93). It is also conceivable to move the pull pin part (91), for example, in a direction transverse to the longitudinal direction (15) or to swivel it in the longitudinal or transverse direction.

Figure 5:
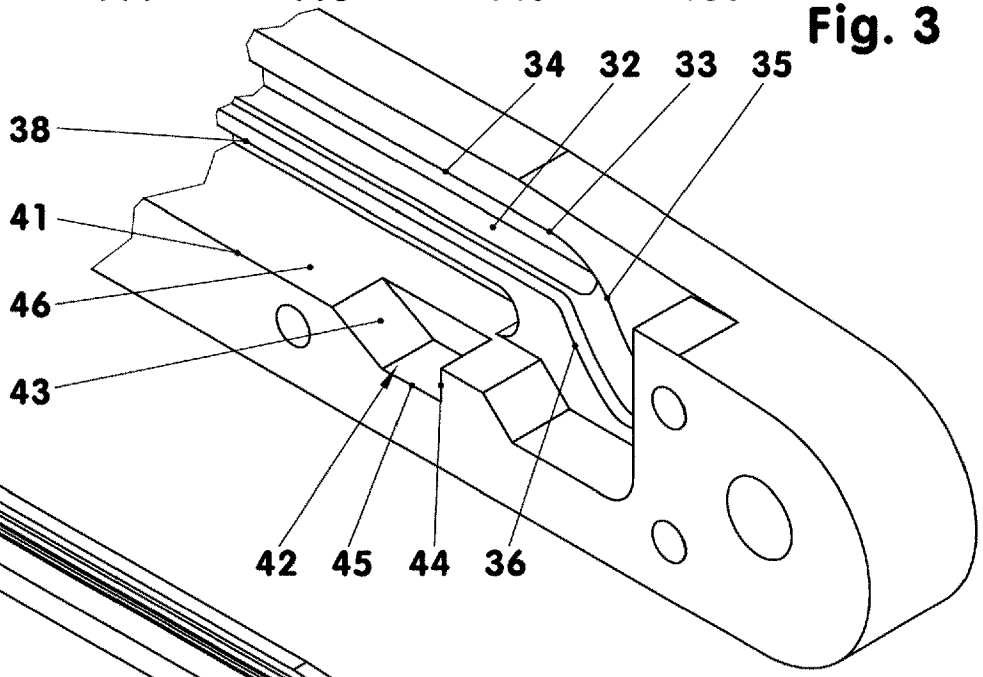
FIG. 5: Detail of FIG. 4.
Figure 4:
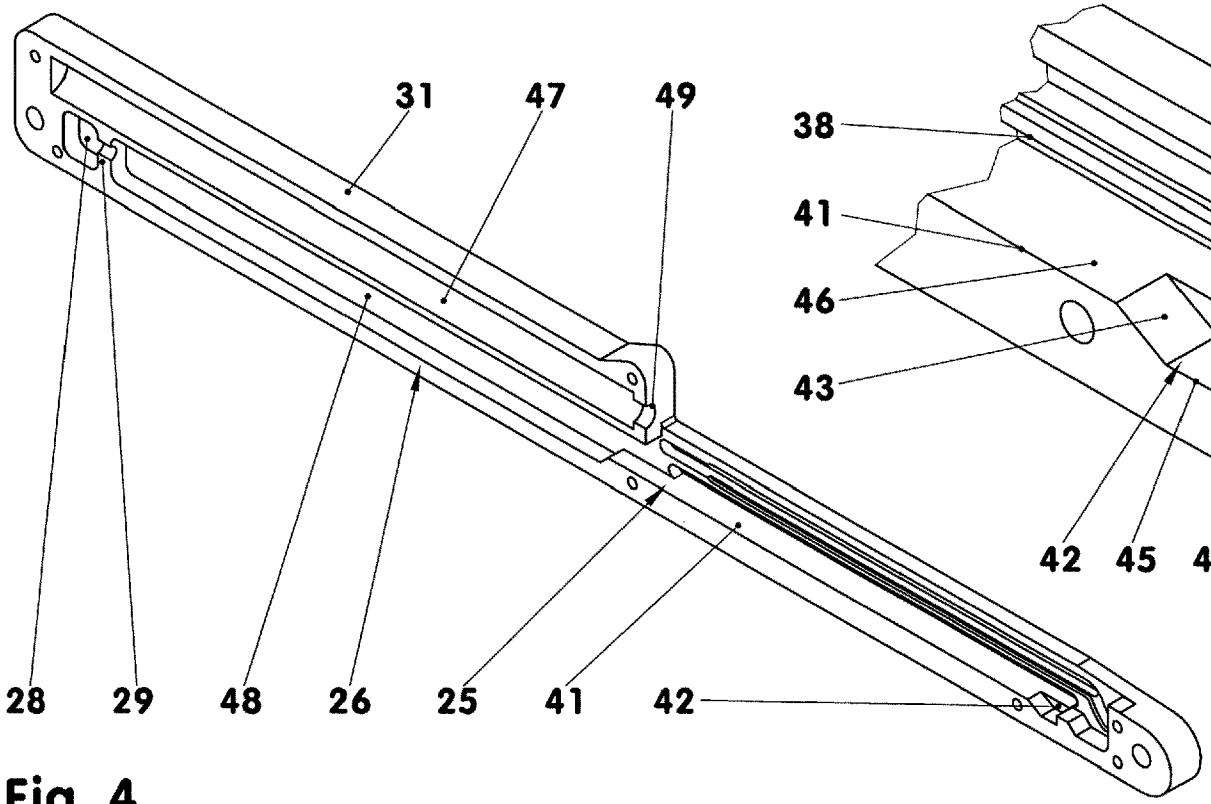
FIG. 4: Housing shell.

FIGS. 4 and 5 show a housing shell (31; 51). The second housing shell (51; 31) is structured as a mirror image thereof. The individual housing shell (31; 51) has guide holders (25) and bearing holders (26). The length of the guide shell (31; 51) shown corresponds to the length of the retraction device (10).

In the exemplary embodiment, the guide holders (25) are formed by four guide tracks (32, 33, 38, 41). A first guide track (32) is arranged horizontally. Its length is, for example, 36% of the length of the housing (20). Its depth in the width direction (17) is 0.8% of the length of the housing (20) in the exemplary embodiment.

A second guide track (33) overlaps the first guide track (32) in certain areas. In the height direction (16), it is one-third higher than the first guide track (32). Its depth in the width direction (17) is one-third of the depth of the first guide track (32) in this direction. In the exemplary embodiment, the second guide track (33) is offset relative to the first guide track (32) by 4% of the length of the housing (20) in the direction turned away from the rear wall (24). However, its end turned towards the rear wall (24) can also coincide with the corresponding end of the first guide track (32). The second guide track (33) has a horizontal section (34) oriented in the longitudinal direction (15), which is followed by a section (35) that is curved several times. The transition between the horizontal section (34) and the section (35) that is curved several times is located, for example, at the end of the first guide track (32) turned away from the rear wall (24). This transition is formed to be tangential.

In the exemplary embodiment, the section (35) that is curved several times has a first area (36) curved downward and a second area (37) curved in the opposite direction, see FIG. 2. For example, the first area (36) covers an angle of 62 degrees. For example, the angle covered by the second area (37) is 21 degrees. The first area (36) and the second area (37) merge tangentially to each other. In the exemplary embodiment, the radius of the second area (37) is four times the radius of the first area. The first guide track (32) and the second guide track (33) can also be formed as a common guide track.

The third guide track (38) is arranged below the first guide track (32) and the second guide track (33) in the illustrations of FIGS. 4 and 5. The third guide track (38) is aligned parallel to the first guide track (32). In the exemplary embodiment, its length is 94% of the length of the first guide track (32). For example, it is arranged at least approximately symmetrically to a vertical center transverse plane of the first guide track (32). The center-to-center distance of the first guide track (32) and the third guide track (38) is, for example, 4.5% of the total stroke of the driving element (60). For example, the depth of the third guide track (38) in the transverse direction (17) and its height in the height direction (16) correspond to the corresponding sizes of the first guide track (32).

In the exemplary embodiment, the fourth guide track (41) is formed to be flush with the lower limit of the third guide track (38) in certain areas. This fourth guide track (41) has a sliding, roller or oscillating section (46) merging with the third guide track (38) and a recess (42). The recess (42) is arranged below the right-hand end of the third guide track (38) in the illustrations of FIGS. 2-5. It has a ramp section (43) oriented in the direction of the rear wall (24) and a stop section (44) turned away from the rear wall (24). The height of the recess (42) in the height direction (16) is, for example, two-thirds of the height of the third guide track (38). In the exemplary embodiment, the ramp section (43) includes an angle of 30 degrees with the longitudinal direction (15).

The bearing holder (26) includes the spring holder (27) and a receiving shell (47) for the cylinder (131). In the exemplary embodiment, the spring retainer (27) is arranged on the rear wall (24). It includes a spring head holder (28) bounded by a spring retaining bar (29). In the area between the spring retaining bar (29) and the guide holders (25), the guide shell (31; 51) forms a spring guide (48), for example.

Above the spring retainer (27), a receiving shell (47) formed as an inner cylinder wall is formed in the guide shell (31; 51). The length of the receiving shell (47) in the longitudinal direction (15) corresponds, for example, to half the length of the housing (20). In the exemplary embodiment, the radius of the receiving shell (47) is 1.4% of the length of the housing (20). The receiving shell (47) is connected to the surrounding area (1) by an aperture (49) coaxial with its center line.

Figure 6:
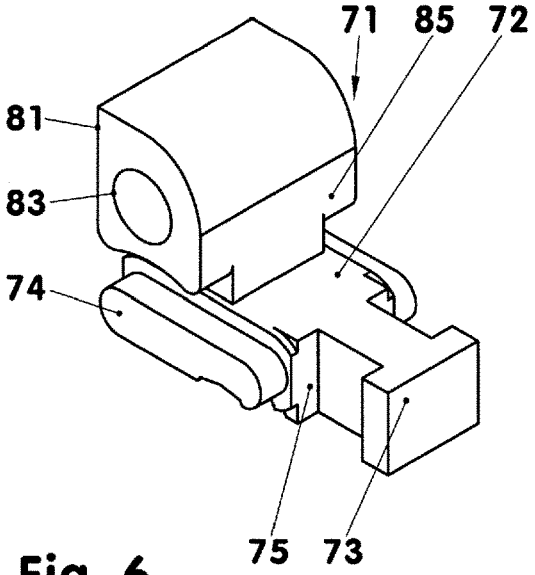
FIG. 6: Push pin part.
Figure 7:
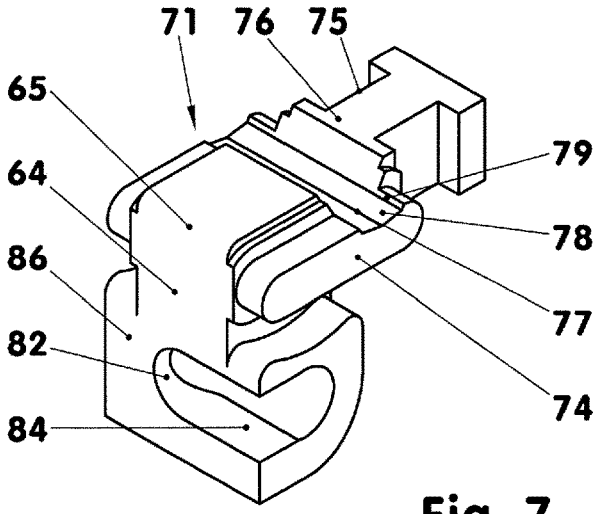
FIG. 7: Bottom view of FIG. 6.

FIGS. 6 and 7 show a push pin part (71) in two isometric views. Thereby, FIG. 6 shows the push pin part (71) from the front and top, while FIG. 7 is a rear and bottom perspective view. For example, the push pin part (71) has a push pin body (72) that is L-shaped in longitudinal section, wherein a first limb (73) is oriented in the longitudinal direction (15) and a second limb (81) projects upwardly from the first limb (81) vertically.

The first limb (73) has a guide pin (74) projecting from the push pin body (72) on each side. The single guide pin (74) has a substantially oval cross-section, the long axis of which is oriented in the longitudinal direction (15). Instead of a single guide pin (74), several guide pins (74) can also be arranged on each side. These can have a circular, oval, elliptical, etc. cross-section.

In front of the guide pins (74), the first limb (73) has two guide grooves (75) opposite to each other. The two guide grooves (75), which are parallel to each other, are aligned vertically, for example. In the exemplary embodiment, they have a rectangular cross-sectional surface. They constrict the first limb (73).

On its lower side (76), the first limb (73) has a transverse channel (77) in the area of the guide pins (74). In the width direction (17), for example, the transverse channel (77) has a constant cross-section. The cross-sectional surface is formed to be prism-shaped, for example. It has two adjacent head surfaces (78), each of which is connected to the lower side (76) by a support surface (79). The length of the transverse channel (77) in the longitudinal direction (15) is, for example, 1.7% of the length of the housing (20). The height of the transverse channel (77) in the height direction (16) is, for example, 0.7% of the length of the housing (20). The transverse channel (77) can also be designed differently. It can have a rectangular, cylindrical shell-shaped, etc. cross-section. It can also have a vertically oriented opening penetrating the first limb (73). Instead of a transverse channel (77), the lower side (76) can also have, for example, a depression in the shape of a spherical segment.

In the exemplary embodiment, the second limb (81) of the push pin part (71) has a piston rod head holder (82). This comprises, for example, a transverse bore (83) oriented in the width direction (17), to which a rod aperture (84) is connected. The rod aperture (84) has, for example, a semi-oval cross-section and connects the piston rod head holder (82) to a rear side (86) of the push pin part (71). With one embodiment of the cylinder-piston unit (130) with a return spring or with a cylinder-piston unit whose cylinder (131) faces the push pin part (71), the push pin part (71) can be formed without a piston rod head holder (82).

On the side turned away from the piston rod head holder (82), the second limb (81) has a push surface (85). In the exemplary embodiment, such push surface (85) is a flat surface oriented normal to the longitudinal direction (15) of the retraction device (10) when the push pin part (71) is installed. The push surface (85) is also normal to the center axis (136) of the cylinder-piston unit (130).

The push pin part (71) has an actuating surface (64) on its rear side (86). This is formed, for example, normal to the longitudinal direction (15). The actuating surface (64) can also have a uniaxial or biaxial curved design. In the exemplary embodiment, the actuating surface (64) merges into the lower side (76) in an arched surface (65). The push pin part (71) can also be formed without an actuating surface (64).

Figure 8:
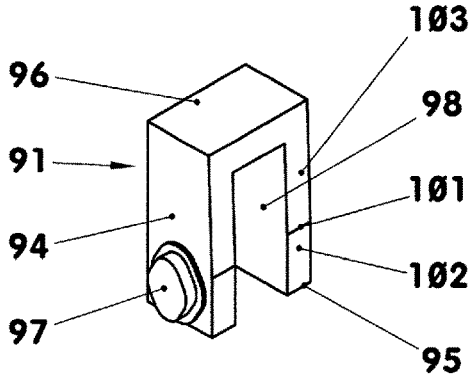
FIG. 8: Pull pin part.

FIG. 8 shows a pull pin part (91). This is, for example, a U-shaped component. It has two vertically oriented sliding limbs (94, 95) connected at their upper end by means of a horizontally oriented connecting limb (96). A sliding pin (97) is arranged on the outer sides of each of the parallel sliding limbs (94, 95). In the exemplary embodiment, the single sliding pin (97) has an at least approximately elliptical cross-sectional surface. The osculating circles of the respective ellipse are connected by straight line segments. The height of the sliding pins (97) oriented in the height direction (16) is, for example, one-third greater than their length oriented in the longitudinal direction (15).

The pull pin part (91) is symmetrical about a vertical central longitudinal plane. The individual sliding limb (94; 95) has a rectangular cross-section in a plane oriented normal to the height direction (16). The respective inner side (98) of the sliding limbs (94, 95) and the end faces (99) located at the rear in the longitudinal direction (15) are formed to be flat and smooth, see FIG. 11. In the exemplary embodiment, the front end face (101) lying in the front in the longitudinal direction (15) comprises two guide surfaces (102, 103). A lower guide surface (102) is arranged parallel to the rear end face (99). An upper guide surface (103) is inclined backwards by 2 degrees relative to the lower guide surface (102). The connecting limb (96) is thus shorter in the longitudinal direction (15) than the sliding limbs (94, 95). Both the lower guide surface (102) and the upper guide surface (103) are formed to be flat and have a smooth surface. The end face (104) of the connecting limb (96), which lies in one plane with the end faces (99) of the sliding limbs (94, 95), forms a pull surface (105) together with the latter. The pull surface (105) is formed as a flat surface.

The pull pin part (91) can also be formed to be asymmetrical. For example, it can be designed with only one sliding limb (94; 95) and/or with only one sliding pin (97).

The driving element (60) can be formed in one piece. It then has, for example, two cylindrical guide pins on both sides, each of which engages in a guide track (33) on the housing side. The push surface (85) and the pull surface (105) are then at a constant distance from each other. The cylinder-piston unit (130) can then be mounted in a swivel joint on the driving element (60). Instead of a transverse channel (77) on the lower side, the one-piece driving element has, for example, a laterally arranged recess. It is also conceivable to connect the push pin part (71) and the pull pin part (91) by means of a film joint.

Figure 9:
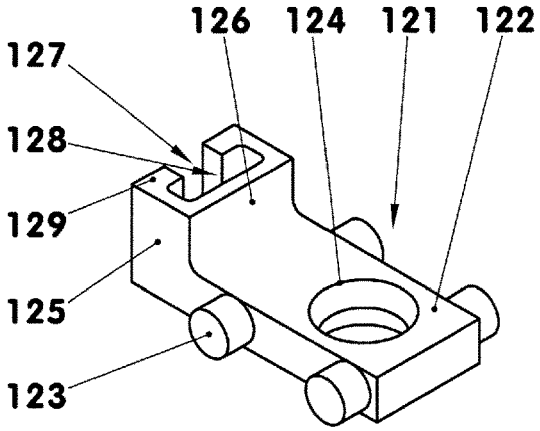
FIG. 9: Pin slider.

A pin slider (121) is illustrated in FIG. 9. For example, it is L-shaped and has a long limb (122) and a short limb (125). The long limb (122) is oriented in the longitudinal direction (15). It has two outer guide pins (123) on each of the two longitudinal sides. These each have a circular cross-sectional surface.

In the long limb (122), for example, a vertical aperture (124) is arranged centrally in the transverse direction (17). Such vertical aperture (124) is formed, for example, in the shape of a double truncated cone, wherein both truncated cones taper towards a horizontal center plane, see FIG. 10. In the exemplary embodiment, all cross-sectional surfaces of the vertical aperture (124) are circular. The boundary surfaces of the vertical aperture (124) can be continuous surfaces in the height direction (16). The vertical aperture (124) can also have a rectangular, elliptical, oval, etc. cross-section.

The short limb (125) projects from the rear end of the pin slider (121) in the illustrations of FIGS. 2 and 3. On its front side, it has an actuating surface (126) on the slide side. Such actuating surface (126) on the slide side is, for example, flat and lies in a normal plane to the longitudinal direction (15). The actuating surface (126) on the slide side can also have a uniaxial or biaxial curved design. For example, it can be a convex surface. In the longitudinal direction (15), the distance between the center line of the vertical aperture (124) and the actuating surface (126) on the slide side corresponds, for example, to the distance between the center line of the transverse channel (77) of the push pin part (71) and the actuating surface (64) of the push pin part (71). The pin slider (121) can also be formed without a pin slider actuating surface (126).

On its rear side, the pin slider (121) has a spring holder (127). This comprises a receiving chamber (128), which is bounded by two retaining bars (129).

During assembly, for example, the pull pin part (91) is first fitted onto the push pin part (71). The sliding limbs (94, 95) of the pull pin part (91) are inserted in the guide grooves (75) of the push pin part (71). Thereby, the guide surfaces (102, 103) of the pull pin part (91) point in the direction turned away from the second limb (81). The piston rod head (135) of the cylinder-piston unit (130), which is formed to be, for example, T-shaped, is inserted into the piston rod head holder (82) of the push pin part (71). The cylinder-piston unit (130) and the driving element (60) are then inserted into a housing shell (31; 51). The cylinder (131) is inserted into the receiving shell (47). A guide pin (74) of the push pin part (71) is guided into the first guide track (32). A slide pin (97) of the pull pin part (91) is inserted into the second guide track (33). After insertion, a straight line containing the center axis (136) of the cylinder-piston unit (130) penetrates the push surface (85) of the push pin part (71).

The pin slider (121) is inserted into the third guide track (38), wherein a blocking element (140) is inserted in the vertical aperture (124). In the exemplary embodiment, the blocking element (140) is a ball (140), which is seated with slight play in the vertical aperture (124). In the exemplary embodiment, its diameter is 10% larger than the distance between the horizontal sliding, rolling or oscillating section (46) of the fourth guide track (41) and the first guide track (32). In the example shown, the diameter of the blocking element (140) is 83% of the distance between the recess bottom (45) and the first guide track (32). Instead of a ball, the blocking element (140) can be a transverse cylinder, an ellipsoid, a prism, etc. For example, the pin slider (121) is inserted into the third guide track (38) in such a manner that the blocking element (140) is located in the sliding, rolling or oscillating section (46) of the fourth guide track (41) and projects into the transverse channel (77) of the driving element (60).

The tension spring (111) is inserted into the spring holders (127) of the pin slider (121) and into the spring retainer (27) of the housing shell (31; 51). The housing (20) is then closed by fitting the second guide shell (51; 31). The two guide shells (31; 51) can now be joined as described above. Another sequence of assembly is also conceivable.

The retraction device (10) can now be mounted on a piece of furniture, for example a drawer or a sliding door. A driver (2) is then attached to the furniture body. After installation, the driving element (60) is pulled into the parked position (62) shown in FIG. 3, for example, with the drawer open.

In the parked position (62) of the retraction device (10) shown in FIG. 3, the pull pin part (91) stands in the section (35) of the second guide track (33) that is curved several times. In such ready position (93), it is lowered relative to the push pin part (71) to such an extent that it projects only slightly from the housing (20). The push pin part (71) is in the first guide track (32). The driving element (60) can be secured in the parked position (62) in a force-fitting and/or positive-locking manner.

The piston rod (132) of the cylinder-piston unit (130) is extended. The piston rod (132) loads the driving element (60) in the direction of the parked position (62). The pin slider (121) is in a forward position. The blocking element (140) lies in the recess (42). For example, it rests against the lower side (76) of the push pin part (71). The driving element (60) thus prevents the pin slider (121) from moving. The housing (20), the blocking element (140) movably guided in the pin slider (121), and the driving element (60) are parts of a coupling (150) that is in a stable first operating state (151) in this illustrated position. Such coupling (150) is a positive-locking switchable mechanical coupling (150) in the form of a claw coupling. The second end (113) of the spring energy accumulator (111) is connected to the housing (20) by the coupling (150). The driving element (60) is movable relative thereto in the longitudinal direction (15). The spring energy accumulator (111) is loaded. The tension spring (111) is tensioned to a maximum operating length.

When closing the drawer, for example, it moves relative to the fixed driver (2). In a partial stroke adjacent to the closed end position, for example of the drawer stroke, the driving element (60) meets the driver (2) with its push surface (85). Thereby, the driving element (60) is loaded in the longitudinal direction (15), without a torque being effective. The force is transmitted linearly to the cylinder-piston unit (130).

Figure 10:
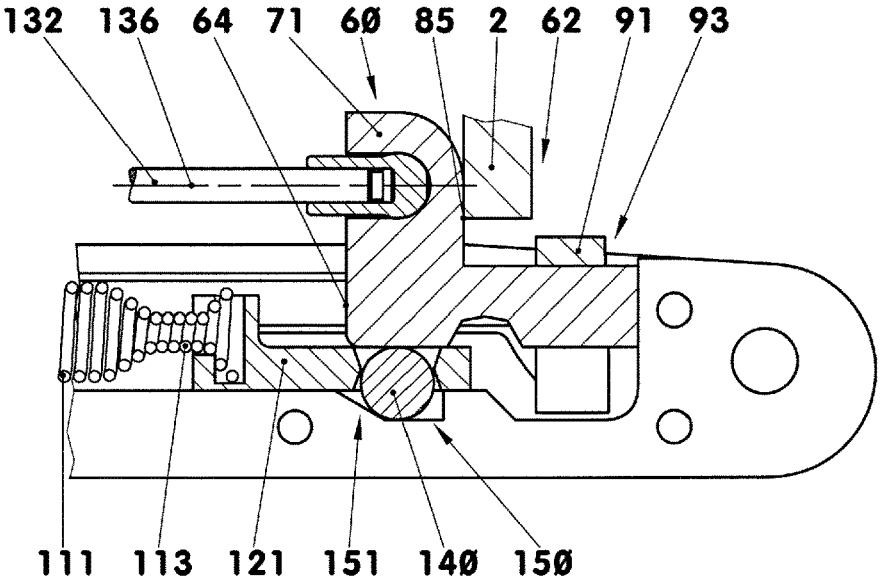
FIG. 10: Partial longitudinal section of the retraction device with the driving element in the parked position.

FIG. 10 shows a partial longitudinal section of the retraction device (10) in contact with the driver (2). Thereby, the driver (2) hits the push surface (85). In the illustration of FIG. 10, the lower edge of the driver (2) lies below the straight line containing the center line (136) and penetrating the push surface (85). The impact force of the driver (2) is introduced into the cylinder-piston unit (130) without deflection.

The driving element (60) is in the parked position (62). Together with the blocking element (140), it blocks the pin slider (121), which holds the tensioned tension spring (111). The actuating surface (64) of the driving element (60) is spaced from the pin slider actuating surface (126). In this illustration, the push direction (18) of the driving element (60) is oriented to the left, for example to the rear. The coupling (150) is locked in the first operating position (151).

Figure 11:
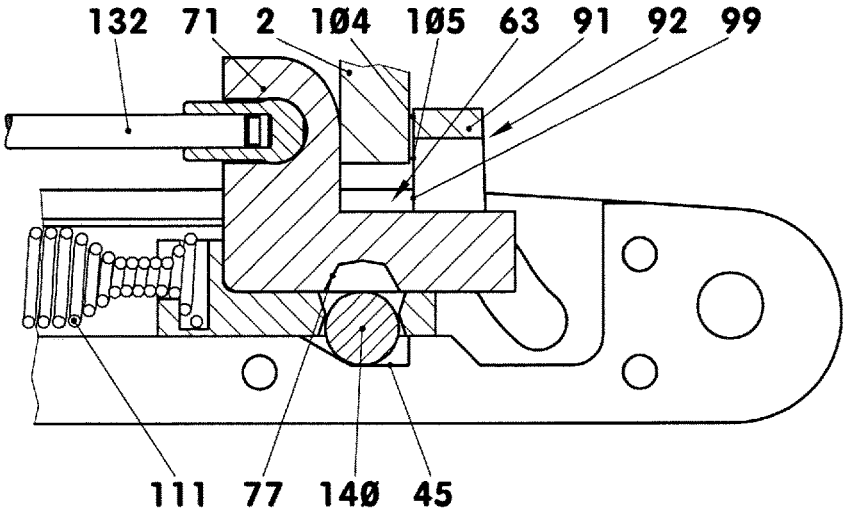
FIG. 11: Partial longitudinal section of the retraction device when the driving element is in contact with the pin slider.

In the illustration in FIG. 11, for example, the drawer is retracted further. The housing (20) of the retraction device (10) and the driver (2) are further moved relative to each other. The driver (2) has moved the driving element (60) in the push direction (18). In this embodiment, the driving element (60) is moved by one-twentieth of the total stroke of the driving element (60) in the push direction (18). For example, the piston rod (132) of the cylinder-piston unit (130) is retracted by the stroke of the driving element (60). In the cylinder (131), for example, the piston displaces oil from the displacement chamber into the compensation chamber. The movements of the driving element (60) and, for example, the drawer are delayed. The drawer is slowed down.

The pull pin part (91) of the driving element (60) is guided on the push pin part (71) and moved upwards along the second guide tracks (33). Thereby, the horizontal section (34) of the second guide track (33) prevents the pull pin part (91) from being lowered again. The pull pin part (91) is in the extended operating position (92). The driver (2) is now seated in a driving recess (63) bounded by the push pin part (71) and the pull pin part (91). In the event of a rebound, the pull pin (91) prevents the driver (2) from being extended again.

The driving element (60) now rests with its actuating surface (64) against the pin slider actuating surface (126). In this non-static state, the transverse channel (77) is above the vertical aperture (124) and the blocking element (140). The blocking element (140) continues to lie in the recess (42). The spring energy accumulator (111) is still connected to the housing (20). However, the coupling (150) is not secured by means of the driving element (60). The driving element (60) has initiated a shift of the coupling (150).

Figure 12:
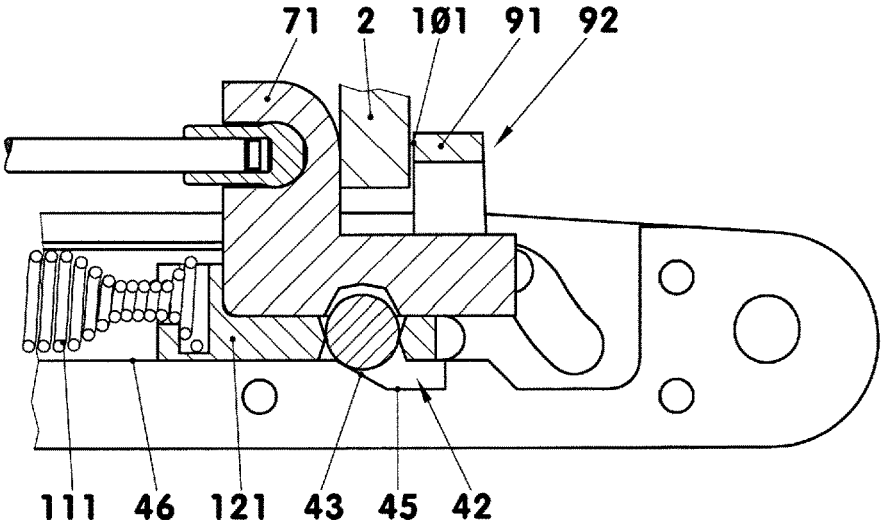
FIG. 12: Partial longitudinal section of the retraction device when the spring energy accumulator is coupled to the driving element.

FIG. 12 shows the retraction device (10) during further insertion of the drawer, for example, or after the drawer has been released. During further insertion, the driving element (60) pushes both the piston rod (132) and the pin slider (121) further in the push direction (18). The driving element (60) is further decelerated. At the same time, the relaxing tension spring (111) pulls the pin slider (121) with the blocking element (140) further in the push direction (18). The blocking element (140) is pulled out of the recess (42) along the ramp section (43). At the same time, the blocking element (140) engages in the transverse channel (77) of the push pin part (71). It thus blocks relative movement between the driving element (60) and the second end (113) of the spring energy accumulator (111). The driving element (60) is now coupled to the spring energy accumulator (111). The second end of the tension spring (111) is moved only in the longitudinal direction (15). Such delayed release of the tension spring (111) compared to the coupling of the driver (2) with the driving element (60) does not generate any noise. The driving element (60) is thus connected to the spring energy accumulator (111) in a partial stroke of its total stroke.

If, for example, the drawer comes to a standstill in the position shown in FIG. 11 and is released, the relaxing tension spring (111) pulls the pin slider (121) in the push direction (18). In this case as well, the blocking element (140) couples the driving element (60) to the spring energy accumulator (111). The piston rod (132) continues to retract in this case as well, wherein the cylinder-piston unit (130) has little to no deceleration effect due to the low speed.

When the pin slider (121) is formed without the short limb (125), the relaxing tension spring (111) pulls along the ramp section (43) in the push direction (18). With such an embodiment as well, the blocking element (140) is moved into the transverse channel (77).

Figure 13:
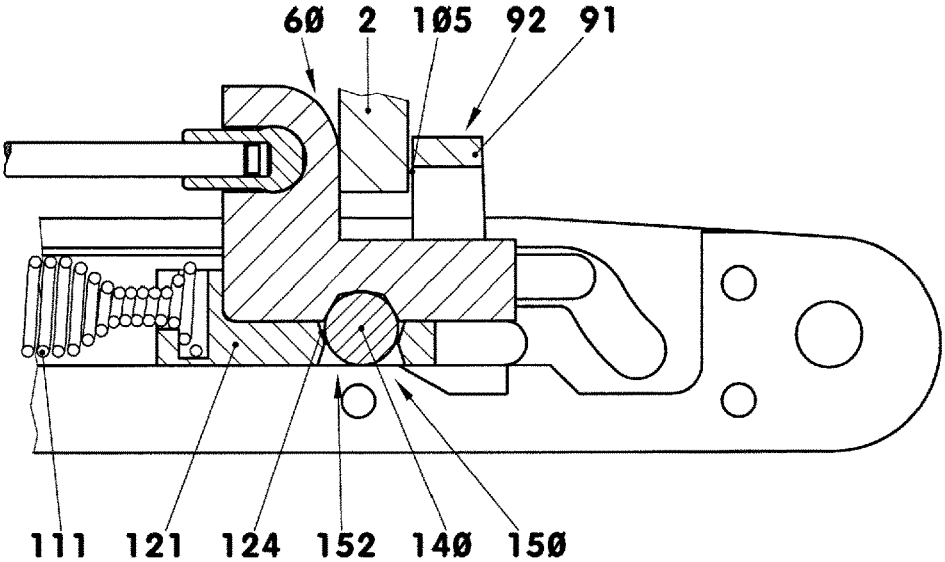
FIG. 13: Partial longitudinal section of the retraction device after coupling the spring energy accumulator with the driving element.

In FIG. 13, the retraction device (10) and the driver (2) are shown in a further retracted state, for example of the drawer. The coupling (150) is now fully switched to a second stable operating state (152). The second end (113) of the spring energy accumulator (111) is connected to the driving element (60). The blocking element (140) mounted in the pin slider (121) sits in the transverse channel (77) in a positive-locking manner, for example. The driving element (60), the housing (20) and the blocking element (140) are also parts of the coupling (150) in such position. Such part of the coupling (150) is also formed as a switchable claw coupling. The blocking element (140) is in contact with the driving element (60) after switching. The sliding, rolling or oscillating section (46) of the fourth guide track (41) prevents the release of the coupling (150).

The blocking element (140) slides, oscillates or rolls along the sliding, rolling or oscillating section (46) of the fourth guide track (41). The driving element (60) is stressed by the resulting force of the acceleration force of the further unloading spring energy accumulator (111) and the deceleration force of the cylinder-piston unit (130). The driving element (60) moves in the direction of the end position (61). For example, the drawer is conveyed to the closed end position at decreasing speed. It remains there without stopping.

In FIG. 2, the retraction device (10) is shown in the end position (61) of the driving element (60). The driving element (60) is in the rear position. The piston rod (132) of the cylinder-piston unit (130) is retracted. The spring energy accumulator (111) is unloaded to a residual energy value. In this case, the spring energy accumulator (111) is still coupled to the driving element (60).

Opening the drawer, for example, takes place in the opposite direction. When the drawer is extended, the driver (2) loads the pull pin part (91) of the driving element (60) in the pull direction (19). Thereby, it is in contact with the pull surface (105) of the pull pin part (91). The driving element (60) entrains the pin slider (121) and the second end (113) of the spring energy accumulator (111) via the coupling (150). In this case, the coupling (150) is in the second stable operating state (152), in which the tension spring (111) is connected to the driving element (60). The tension spring (111) is tensioned. The piston rod (132) of the cylinder-piston unit (130) is extended either by the driving element (60) or by a return spring.

The driving element (60) moves the blocking element (140) further in the pull direction (19). As soon as, depending on the path of the driving element (60), the blocking element (140) reaches the ramp section (43), the blocking element (140) slides, rolls or oscillates along the ramp section (43) into the recess (42), see FIG. 12. The driving element (60) has passed through the partial stroke adjacent to the end position (61), in which it is connected to the spring energy accumulator (111). The coupling (150) is switched. The connection of the driving element (60) to the pin slider (121) is released. The second end (113) of the spring energy accumulator (111) with the pin slider (121) is coupled to the housing (20), see FIG. 11. A release of the coupling (150) is blocked by the driving element (60) moving further in the pull direction (19). The second end (113) of the spring energy accumulator (111) is thus fixed to the housing (20).

When the driving element (60) reaches the parked position (62), the pull pin part (91) moves downward relative to the push pin part (71). The driver (2) is released. For example, the drawer can now be opened further without any problems and largely without resistance.

When using a one-piece driving element (60), for example, the housing (20) has a recess (42) arranged laterally in a guide shell (31; 51). In this case, the spring energy accumulator (111) can also be alternatively coupled to the housing (20) or to the driving element (60) by means of a blocking element (140).

Figure 14:
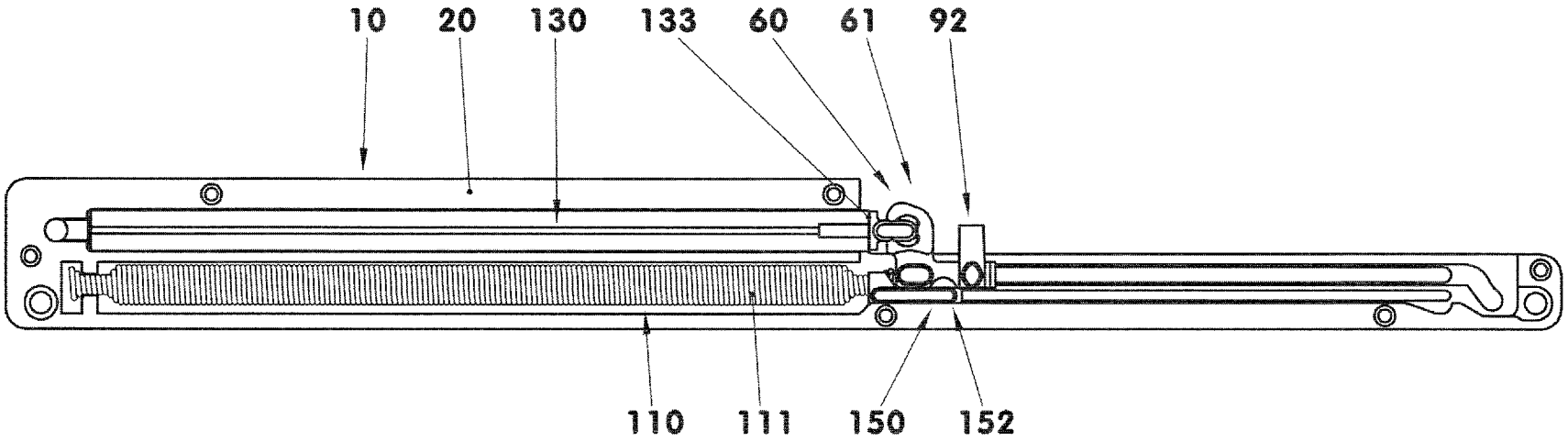
FIG. 14: Retraction device with a modified cylinder-piston unit in the end position.
Figure 15:
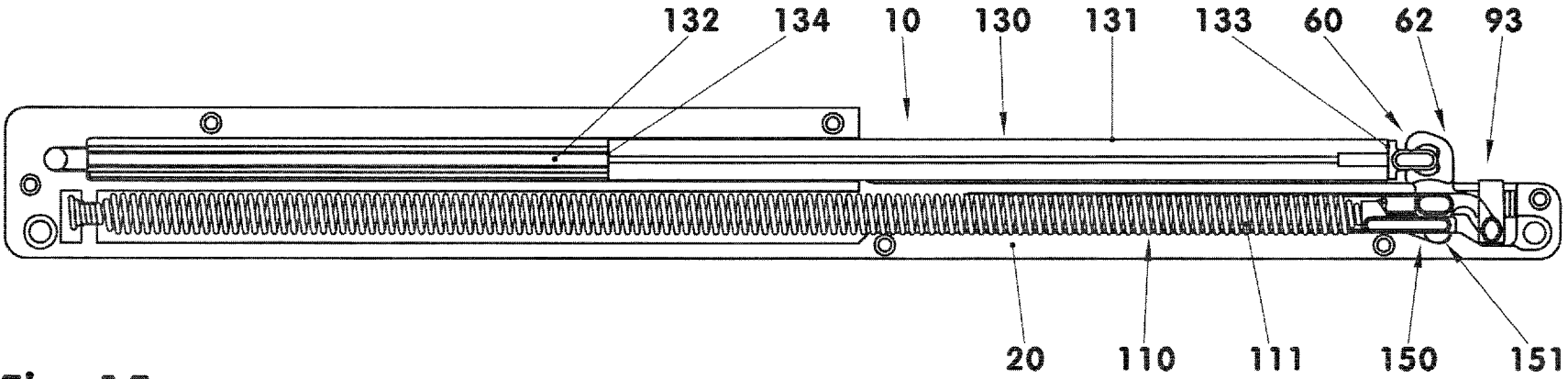
FIG. 15: Retraction device shown in FIG. 14 in the parked position.

FIGS. 14 and 15 show an additional retraction device (10). In the illustration of FIG. 14, the driving element (60) is in the end position (61). FIG. 15 shows this retraction device (10) with the driving element (60) in the parked position (62). The structure and function of the retraction device (10) shown in these FIGS. largely corresponds to the structure and function of the retraction device (10) described in connection with the exemplary embodiment shown in FIGS. 1-13.

In the exemplary embodiment of FIGS. 14 and 15, the cylinder-piston unit (130) is arranged in the housing (20) in such a way that the piston rod (132) is fixed to the rear wall (24) or can be placed against the rear wall (24). The cylinder (131) is axially movable in the longitudinal direction (15) of the retraction device (10). If necessary, in this exemplary embodiment, the guide of the push pin part (71) in the housing (20) can be omitted.

When closing the drawer, any transverse forces acting on the piston rod (132) are further reduced. This prevents leaks from the cylinder-piston unit (130) even with many load cycles.

Combinations of the individual embodiments are also conceivable.

LIST OF REFERENCE SIGNS

1 Surrounding area
2 Driver
10 Retraction device, combined acceleration and deceleration device
11 Deceleration device
15 Longitudinal direction
16 Height direction
17 Width direction, transverse direction
18 Push direction
19 Pull direction
20 Housing
21 Upper side of (20)
22 Longitudinal slot
23 Interior of (20)
24 Rear wall
25 Guide holders
26 Bearing holders
27 Spring retainer; spring holder
28 Spring head holder
29 Spring retaining bar
31 Housing shell, guide shell
32 Guide track, first guide track
33 Guide track, second guide track
34 Horizontal section
35 Section curved several times
36 First area of (35)
37 Second area of (35)
38 Guide track, third guide track
41 Guide track, fourth guide track
42 Recess
43 Ramp section
44 Stop section
45 Recess bottom
46 Sliding, rolling or oscillating section
47 Receiving shell
48 Spring guide
49 Aperture
51 Housing shell, housing shell
60 Driving element
61 End position
62 Parked position
63 Driving recess
64 Actuating surface
65 Arched surface
71 Push pin part
72 Push pin body
73 First limb
74 Guide pin
75 Guide grooves
76 Lower side
77 Transverse channel, claw
78 Head surfaces
79 Support surface
81 Second limb
82 Piston rod head holder
83 Transverse bore
84 Rod aperture
85 Push surface
86 Rear side of (71)
91 Pull pin part
92 Extended operating position
93 Retracted ready position
94 Sliding limb
95 Sliding limb
96 Connecting limb
97 Sliding pin
98 Inner side
99 End face
101 End face
102 Lower guide surface
103 Upper guide surface
104 End face of (96)
105 Pull surface
110 Spring assembly
111 Spring energy accumulator, tension spring
112 First end of (111)
113 Second end of (111)
121 Pin slider
122 Long limb of (121)
123 Guide pins
124 Vertical aperture
125 Short limb
126 Actuating surface on the slide side, pin slider actuating surface
127 Spring holder
128 Receiving chamber
129 Retaining bars

130 Cylinder-piston unit
131 Cylinder
132 Piston rod
133 Cylinder base
134 Cylinder head
135 Piston rod head
136 Center axis
140 Blocking element, ball
150 Coupling
151 First stable operating condition
152 Second stable operating condition

The invention claimed is:

1. A retraction device (10), comprising:
a housing (20),
a driving element (60) guided in the housing (20) between a parked position (62) and an end position (61),
a spring energy accumulator (111) having a first end (112) that is connected to the housing (20),
wherein the spring energy accumulator (111) is loaded to a maximum operating value when the driving element (60) is in the parked position (62) and is unloaded to a residual energy value when the driving element (60) is in the end position (61); and
a bistable coupling (150) by which a second end (113) of the spring energy accumulator (111) is,
in a first stable operating state (151), fixed to the housing (20) and,
in a second stable operating state (152), coupled to the driving element (60),
wherein the coupling (150) has a blocking element (140) that can be moved between engaging the housing (20) and engaging the driving element (60).

2. The retraction device (10) according to claim 1,
wherein the bistable coupling (150) is an externally actuated switchable claw coupling, an actuating element of which is the driving element (60).

3. The retraction device (10) according to claim 2,
wherein the bistable coupling (150) can be reversed in a path-dependent manner by the driving element (60).

4. The retraction device (10) according to claim 1,
wherein the housing (20) and the driving element (60) limit a coupling stroke of the blocking element (140) in both stable operating states (151, 152) of the coupling (150).

5. The retraction device (10) according to claim 1,
wherein the second end (113) of the spring energy accumulator (111) is held in a pin slider (121) encompassing the blocking element (140).

6. The retraction device (10) according to claim 1,
wherein, when the driving element (60) is in the parked position (62), the second end (113) of the spring energy accumulator (111) is coupled to the housing (20), and
wherein, when the driving element (60) is in the end position (61), the second end (113) of the spring energy accumulator (111) is coupled to the driving element (60).

7. The retraction device according to claim 1,
wherein the driving element (60) has a push pin part (71) and a pull pin part (91), the pull pin part (91) being movable relative to and mounted on the push pin part (71).

8. The retraction device (10) according to claim 7,
wherein the pull pin part (91) is movable on the push pin part (71) in a plane normal to a longitudinal direction (15) of the retraction device (10) by a guide track (33) arranged in the housing (20).

9. The retraction device (10) according to claim 8,
further comprising a cylinder-piston unit (130) that is coupled to or can be coupled to the driving element (60) and that is mounted in the housing (20).

10. The retraction device (10) according to claim 9,
wherein a straight line containing a center axis (136) of the cylinder-piston unit (130) penetrates a push surface (85) of the push pin part (71) orthogonally.

* * * * *